US011453967B2

(12) United States Patent
Park et al.

(10) Patent No.: US 11,453,967 B2
(45) Date of Patent: Sep. 27, 2022

(54) CLOTHES CARE APPARATUS AND CONTROL METHOD THEREOF

(71) Applicant: Samsung Electronics Co., Ltd., Suwon-si (KR)

(72) Inventors: Kisun Park, Suwon-si (KR); Judai Kim, Suwon-si (KR); Sangyun Bae, Suwon-si (KR); Jinseung Choi, Suwon-si (KR); Inhee Hong, Suwon-si (KR); Yongpil Park, Suwon-si (KR); Hyeongjoon Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/113,269

(22) Filed: Dec. 7, 2020

(65) Prior Publication Data

US 2021/0180233 A1 Jun. 17, 2021

(30) Foreign Application Priority Data

Dec. 11, 2019 (KR) ..... 10-2019-0164762

(51) Int. Cl.
*D06F 33/43* (2020.01)
*D06F 35/00* (2006.01)
(Continued)

(52) U.S. Cl.
CPC ..... *D06F 35/008* (2013.01); *D06F 33/34* (2020.02); *D06F 33/42* (2020.02); *D06F 33/43* (2020.02);
(Continued)

(58) Field of Classification Search
CPC ..... D06F 33/43; D06F 33/69; D06F 35/008; D06F 39/008; D06F 58/45; D06F 73/00; D06F 73/02
See application file for complete search history.

(56) References Cited

U.S. PATENT DOCUMENTS

2008/0302142 A1* 12/2008 Park ..... D06F 39/008 68/5 R
2010/0064446 A1 3/2010 Bae et al.
(Continued)

FOREIGN PATENT DOCUMENTS

CN 101839468 7/2012
KR 10-0925434 11/2009
(Continued)

OTHER PUBLICATIONS

International Search Report dated Mar. 15, 2021 in International Patent Application No. PCT/KR2020/017387.

*Primary Examiner* — David G Cormier
(74) *Attorney, Agent, or Firm* — Staas & Halsey LLP

(57) ABSTRACT

Provided is a clothes care apparatus capable of removing scale generated in a steam device. The clothes care apparatus includes a main body including a clothes care room and a steam generating device provided to supply steam into the clothes care room, wherein the steam generating device includes steam container, a wash liquid injecting part provided to inject a wash liquid for removing scale in the steam container, a heating part provided inside the steam container to heat the wash liquid, and a wash liquid discharging part provided to discharge the wash liquid having cleaned the scale using heat received from the heating part, wherein the wash liquid discharging part includes a second pump provided to discharge the wash liquid having cleaned the scale to an outside of the steam container.

17 Claims, 12 Drawing Sheets

(51) Int. Cl.

| | |
|---|---|
| ***D06F 39/00*** | (2020.01) |
| ***D06F 39/04*** | (2006.01) |
| ***D06F 39/08*** | (2006.01) |
| ***D06F 34/32*** | (2020.01) |
| ***D06F 33/34*** | (2020.01) |
| ***D06F 33/42*** | (2020.01) |
| *D06F 105/02* | (2020.01) |
| *D06F 103/18* | (2020.01) |
| *D06F 105/10* | (2020.01) |
| *D06F 105/08* | (2020.01) |

(52) U.S. Cl.
CPC ..... *D06F 34/32* (2020.02); *D06F 39/008* (2013.01); *D06F 39/04* (2013.01); *D06F 39/085* (2013.01); *D06F 2103/18* (2020.02); *D06F 2105/02* (2020.02); *D06F 2105/08* (2020.02); *D06F 2105/10* (2020.02)

(56) References Cited

U.S. PATENT DOCUMENTS

| | | | | |
|---|---|---|---|---|
| 2010/0212368 | A1* | 8/2010 | Kim | D06F 25/00 68/19 |
| 2011/0030147 | A1* | 2/2011 | Yoo | D06F 58/44 8/137 |
| 2016/0177489 | A1* | 6/2016 | Ahn | D06F 58/203 68/5 C |
| 2018/0298549 | A1* | 10/2018 | Nam | D06F 39/008 |

FOREIGN PATENT DOCUMENTS

| | | |
|---|---|---|
| KR | 10-1079584 | 11/2011 |
| KR | 10-1342376 | 12/2013 |
| KR | 10-1366265 | 2/2014 |
| KR | 10-1420883 | 7/2014 |
| KR | 10-2018-0116037 | 10/2018 |

* cited by examiner

CLOTHES CARE APPARATUS AND CONTROL METHOD THEREOF

CROSS-REFERENCE TO RELATED APPLICATION

This application is based on and claims priority under 35 U.S.C. § 119 to Korean Patent Application No. 10-2019-0164762, filed on Dec. 11, 2019 in the Korean Intellectual Property Office, the disclosure of which is incorporated herein by reference.

BACKGROUND

1. Field

The disclosure relates to a clothes care apparatus, and more specifically, to a clothes care apparatus that removes dust attached to clothes or odor of clothes.

2. Description of Related Art

A clothes care apparatus is a device that performs clothes care, such as drying wet clothes, removing dust attached to clothes or odors permeated in clothes, and reducing wrinkles of clothes.

In general, the clothes care apparatus includes a cabinet in which a clothes care room for accommodating clothes is formed, and a door provided to open and close the cabinet.

The clothes care apparatus may include a cycle module determining drying performance, a fan module generating airflow, a steam module generating steam, and a drain module collecting and draining residual water as main modules thereof.

Among the main modules, the steam module may be provided to perform a refresh function, such as wrinkle removal, odor removal, static electricity removal, and the like. The steam module is an important module that determines the performance of the clothes care apparatus, such as wrinkle performance and sterilization performance.

The steam module may include a pump and a valve that may supply water, a water level sensor that may check the amount of water supplied, a heater that boils water, a temperature sensor that measures the temperature of the water, a steam container assembled to a counterpart while storing water, and hoses through which water is transferred to the steam container.

Water used in the steam module may contain a large amount of minerals in some regions, and scaling may occur when the minerals directly come in contact with a heater.

When the scale is attached to the water level sensor, energization may occur in the water level sensor, which may cause the water level sensor to erroneously operate, and disconnecting or malfunction of a heater introduced by the scale may cause a risk of fire.

In addition, the odor due to the scale may flow into the clothes care apparatus.

SUMMARY

According to an aspect of the disclosure, there is provided a clothes care apparatus including: a main body including a clothes care room; and a steam generating device provided to supply steam into the clothes care room, wherein the steam generating device includes: a steam container; a wash liquid injecting part provided to inject a wash liquid for removing scale in the steam container; a heating part provided inside the steam container to heat the wash liquid; and a wash liquid discharging part provided to discharge the wash liquid having cleaned the scale using heat received from the heating part, wherein the wash liquid discharging part includes a second pump provided to discharge the wash liquid having cleaned the scale to an outside of the steam container.

The clothes care apparatus may further include a sump provided to accommodate the wash liquid having cleaned the scale that is discharged from the second pump.

The wash liquid discharging part may include: a third pump connected to the sump to drain the wash liquid having cleaned the scale; and a drain container configured to accommodate the wash liquid having cleaned the scale that is discharged from the third pump.

The second pump may further include a valve.

The second pump may be arranged at a position lower than a position of the steam container.

The clothes care apparatus may further include a connecting pipe connecting the steam container to the second pump, wherein the connecting pipe may connect a lower portion of the steam container to at least a portion of the second pump.

The wash liquid injecting part may include: a supply water container provided to supply water to the steam container; a first pump provided to move the wash liquid introduced into the supply water container to the steam container; a first connecting member connecting the first pump to the steam container; and a first valve provided on a path of the first connecting member.

The clothes care apparatus may further include a water level sensor configured to detect an amount of water in the steam container.

According to another aspect of the disclosure, there is provided a clothes care apparatus including an inputter.

The clothes care apparatus may further include a controller configured to, upon determining that the scale is generated on the water level sensor by comparing a reference sensor value corresponding to a predetermined clothes care course with an output signal of the water level sensor, control the wash liquid injecting part and the wash liquid discharging part to discharge the wash liquid through the steam container based on a user command received through the inputter.

The controller, when an amount of change in the output signal is less than a predetermined value and water is introduced into the steam container based on an output signal of another sensor included in the clothes care apparatus, may determine that the scale is generated on the water level sensor.

The controller, upon determining that water exists in the steam container based on the output signal at a time point when a predetermined time has elapsed since steam is supplied into the clothes care room, may determine that the scale is generated on the water level sensor.

The controller, upon determining that the scale is generated on the water level sensor, may heat the wash liquid through the heating part based on the user command.

The controller, upon determining that the scale is generated on the water level sensor, may heat the wash liquid through the heating part to a predetermined temperature range for a predetermined time based on the user command.

The controller may heat the wash liquid through the heating part for a predetermined time.

The controller, in response to a temperature of the wash liquid being exceeding a predetermined temperature, may stop discharging the wash liquid.

The clothes care apparatus may further include a display, and the controller, upon determining that the scale is generated on the water level sensor, may output an image on the display to guide removal of the scale.

The controller, in response to a predetermined time elapsed since an operation of removing the scale starts, may output an image to guide removal of a drain water container included in the wash liquid discharging part.

The controller, upon determining that the scale is generated on the water level sensor, may inject the wash liquid into the steam container for a predetermined minimum time.

The controller, upon determining that an amount of the wash liquid included in the steam container being excessing a capacity of the steam container based on an output signal of another sensor included in the clothes care apparatus, may stop injecting the wash liquid.

The clothes care apparatus may further include: an inputter; and a controller configured to, upon determining that the scale is generated on the water level sensor by comparing a reference sensor value corresponding to a predetermined clothes care course with an output signal of the water level sensor, control the second pump to discharge the wash liquid through the steam container based on a user command received through the inputter.

According to another aspect of the disclosure, there is provided a method of controlling a clothes care apparatus, the method including: upon determining that scale is generated on a water level sensor by comparing a reference sensor value corresponding to a predetermined clothes care course with an output signal of a water level sensor provided in a steam container, outputting an image on a display to guide removal of the scale; controlling a wash liquid injecting part and a wash liquid discharging part to discharge a wash liquid through the steam container based on a user command received through an inputter; and outputting an image to guide removal of a drain water container in response to a predetermined time elapsed since an operation of removing the scale starts.

The controlling of the wash liquid injecting part and the wash liquid discharging part to discharge the wash liquid through the steam container may include controlling a heating part to heat the wash liquid.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
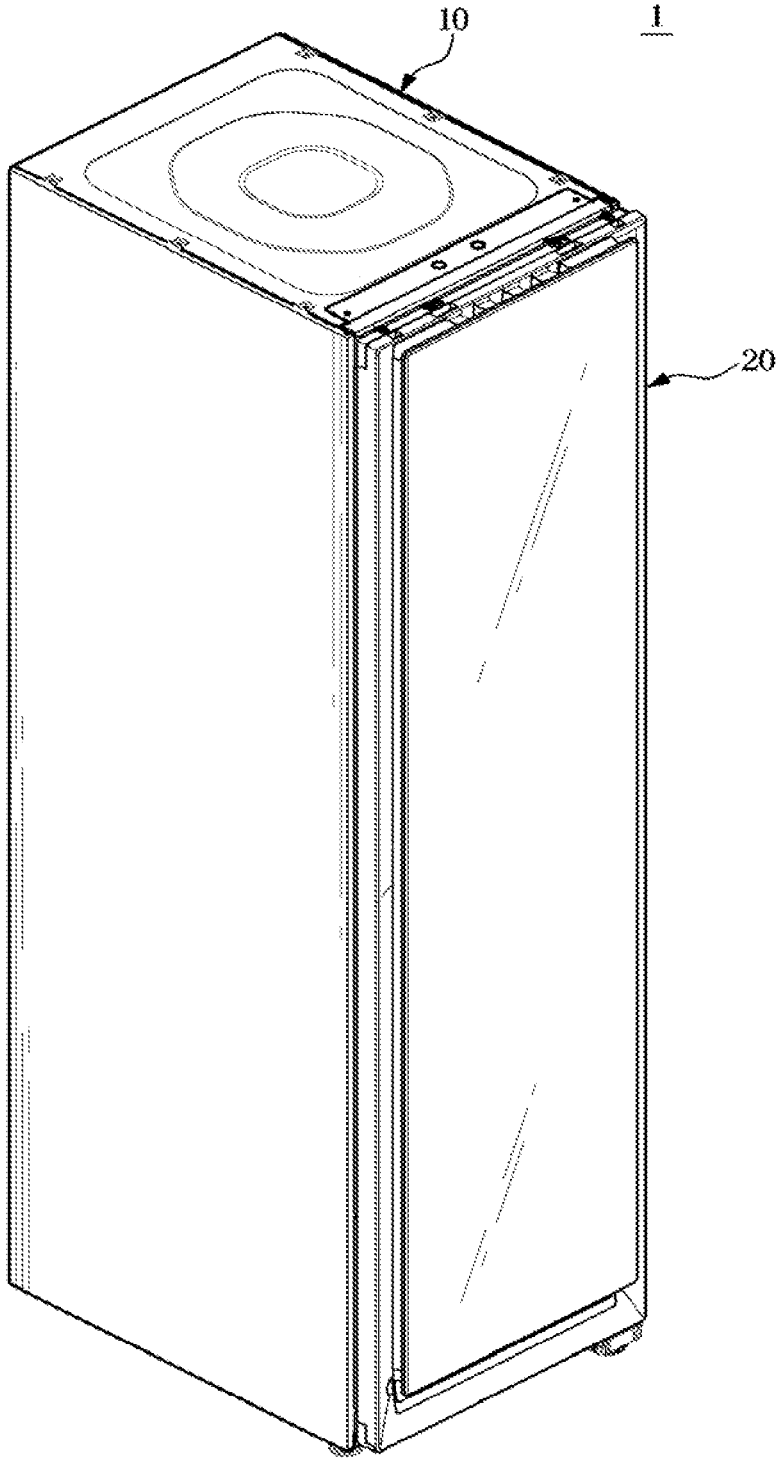
FIG. 1 is a perspective view illustrating a clothes care apparatus according to an embodiment of the disclosure.

The embodiments set forth herein and illustrated in the configuration of the present disclosure are only the most preferred embodiments and are not representative of the full the technical spirit of the present disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

Therefore, it is an object of the disclosure to provide a clothes care apparatus with an improved structure of a steam device.

It is another object of the disclosure to provide a clothes care apparatus capable of cleaning scale generated in a steam device.

Hereinafter, embodiments according to the disclosure will be described in detail with reference to the accompanying drawings.

Figure 2:
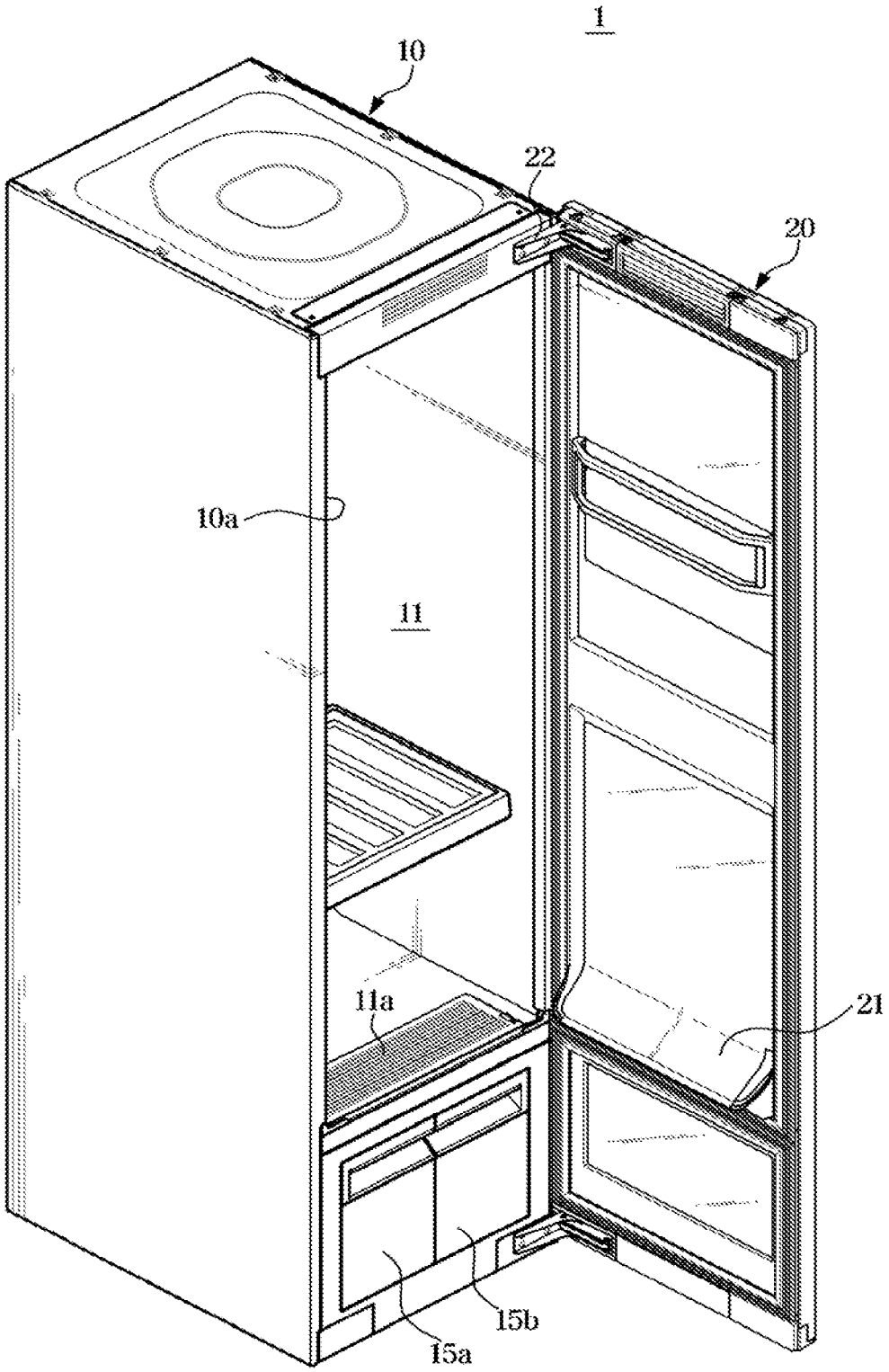
FIG. 2 is a view illustrating an open state of a door of a clothes care apparatus according to an embodiment of the disclosure.
Figure 3:
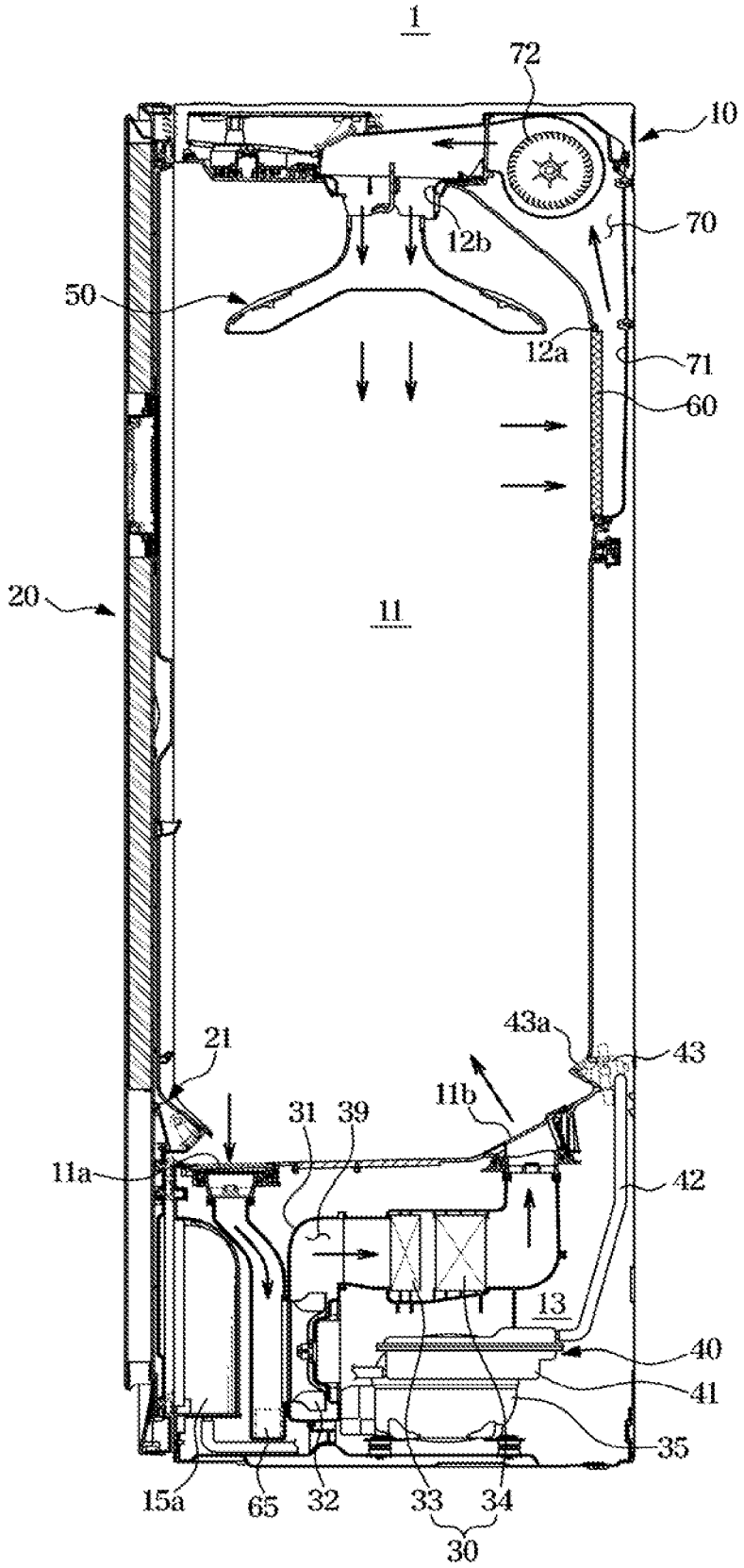
FIG. 3 is a cross-sectional view illustrating a clothes care apparatus according to an embodiment of the disclosure.
Figure 4:
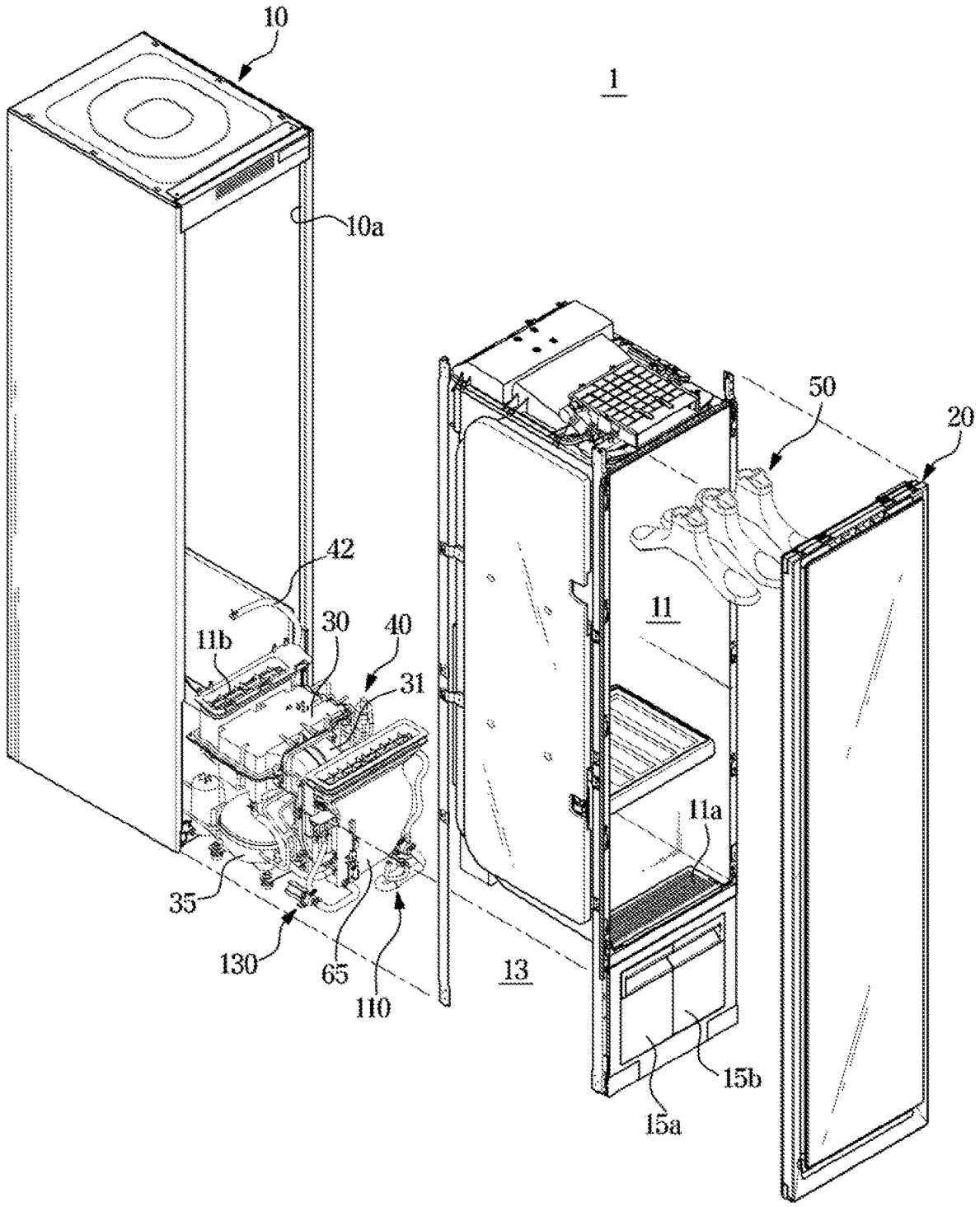
FIG. 4 is an exploded perspective view illustrating a clothes care apparatus according to an embodiment of the disclosure.

FIG. 1 is a perspective view illustrating a clothes care apparatus according to an embodiment of the disclosure, FIG. 2 is a view illustrating an open state of a door of a clothes care apparatus according to an embodiment of the disclosure, FIG. 3 is a cross-sectional view illustrating a clothes care apparatus according to an embodiment of the disclosure, and FIG. 4 is an exploded perspective view illustrating a clothes care apparatus according to an embodiment of the disclosure, Referring FIGS. 1 to 4, a clothes care apparatus 1 includes a main body 10 forming the external appearance thereof, a door 20 rotatably coupled to the main body 10, a clothes care room 11 provided in the main body 10 such that clothes are accommodated and cared therein, a clothes support member 50 provided in the clothes care room 11 to hold the clothes, and a machine room 13 provided with a heat exchange device 30 to heat or dehumidify air in the clothes care room 11.

The main body 10 may be provided with the clothes care room 11 therein, and may have a rectangular parallelepiped shape with one side open. An opening 10*a* may be formed in the front surface of the main body 10. A door 20 may be rotatably coupled to the opening 10*a* of the main body 10 to open and close the main body 10. The door 20 may be installed to open and close the clothes care room 11. The door 20 may be installed on the main body 10 through a connecting member, such as a hinge 22.

The clothes care room 11 forms a space in which clothes are accommodated. The clothes support member 50 may be provided in the clothes care room 11 such that clothes may be mounted and supported thereon. The clothes support member 50 may be detachably mounted on an upper side of the clothes care room 11. The clothes support member 50 may be provided in plural. The clothes support member 50 may be formed in the shape of a hanger so that clothes may be mounted thereon. The clothes support member 50 may be provided to allow air to flow therein. Dust or foreign substance on the clothes may be removed by the air supplied into the clothes support member 50.

The clothes care room 11 may include a first airflow inlet 11*a*, a second airflow inlet 12*a*, a first airflow outlet 11*b*, a second airflow outlet 12*b*, and a steam outlet 43*a*. In the clothes care room 11, the first airflow inlet 11*a* and the first airflow outlet 11*b* may be formed on a lower surface of the clothes care room 11. In the clothes care room 11, the first airflow inlet 11*a* may be disposed in a front portion of the lower surface of the clothes care room 11, and the first airflow outlet 11*b* may be disposed in a rear portion of the lower surface of the clothes care room 11. The second airflow inlet 12*a* may be formed on a rear surface of the clothes care room 11. The second airflow outlet 12*b* may be formed in the center of the upper surface of the clothes care room 11. The second airflow inlet 12*a* and the second airflow outlet 12*b* may be disposed adjacent to each other.

The first airflow outlet 11*b* may be provided with an exhaust grille (not shown) for allowing airflow to spread effectively inside the clothes care room 11.

The second airflow outlet 12*b* of the clothes care room 11 may be connected to the clothes support member 50. Air discharged through the second airflow outlet 12*b* is transmitted to the clothes mounted on the clothes support member 50 through an air hole (not shown) formed in the clothes support member 50.

A drain water container 15*a* and a supply water container 15*b* provided to be detachable from the main body 10 may be installed at a lower side of the main body 10. The drain water container 15*a* and the supply water container 15*b* may be disposed at a lower side of the clothes care room 11. The drain water container 15*a* is provided to facilitate handling of condensate. The supply water container 15*b* stores water required to generate steam in a steam generating device 40, which will be described below. Water from the supply water container 15*b* is supplied to the steam generating device 40 and is used to form steam. The supply water container 15*b* may be installed to be detachable from the main body 10 to facilitate water replenishment. The drain water container 15*a* and the supply water container 15*b* may be provided in front of the machine room 13. The machine room 13 is provided at a lower side of the main body 10. The supply water container 15*b* and the drain water container 15*a* will be described below.

The machine room 13 is provided at a lower side of the clothes care room 11. The machine room 13 may include a heat exchange device 30 provided to dehumidify and heat air inside the clothes care room 11 as needed.

Inside the machine room 13, a blower fan 32, the heat exchange device 30, and the steam generating device 40 may be disposed.

The heat exchange device 30 is installed to supply hot air into the clothes care room 11. The heat exchange device 30 includes an evaporator 33, a compressor 35, and a condenser 34, through which a refrigerant circulates, and is provided to dehumidify and heat air.

A refrigerant, while being evaporated in the evaporator 33 of the heat exchange device 30, absorbs latent heat of surrounding air to condensate and remove moisture in the air. In addition, when the refrigerant is condensed in the condenser 34 after passing through the compressor 35, the refrigerant is caused to release latent heat toward the surrounding air, thereby heating the surrounding air. That is, the evaporator 33 and the condenser 34 serve as a heat exchanger, and the air flowing into the machine room 13 by the blower fan 32 is sequentially dehumidified and heated through the evaporator 33 and the condenser 34.

The heat exchange device 30 installed in the machine room 13 includes a first duct 31 connecting the evaporator 33, the condenser 34, and the blower fan 32, and the first duct 31 is connected to the clothes care room 11 to form a first circulation passage 39 circulating between the clothes care room 11 and the first duct 31.

The first duct 31 may be connected to the first airflow inlet 11*a* and the first airflow outlet 11*b* of the clothes care room 11. Air from the clothes care room 11 is introduced into the first duct 31 through the first airflow inlet 11*a*, in which the air is dehumidified and then is discharged back to the clothes care room 11 through the clothes care room 11*b*.

The first duct 31 is provided to dehumidify the air introduced through the first airflow inlet 11*a* and then discharge the dehumidified air to the clothes care room 11*b*. The blower fan 32 is provided on the first duct 31 to suck air from the clothes care room 11 into the first duct 31.

Air from the clothes care room 11 may be introduced into the first circulation passage 39 through the first airflow inlet 11*a*. The introduced air passes through the heat exchange device 30 to be dehumidified and heated, and the dehumidified and heated air may be discharged back to the clothes care room 30 through the first airflow outlet 11*b*.

The door 20 may include a door guide 21 for guiding movement of condensed water. The door guide 21 is provided to guide condensed water formed by condensation on a rear surface of the door 20. The door guide 21 may be formed to be inclined downward toward the clothes care room 30 from the rear surface of the door 20. The condensed water introduced through the first airflow inlet 11*a* may be moved to the drain water container 15*a* by a sump 65.

The sump 65 may be disposed in the first duct 31. Condensed water introduced through the first airflow inlet 11*a* of the clothes care room 11 may be stored in the sump 65 disposed in a lower portion of the first duct 31.

The clothes care room 11 may include a blower device 72 for flowing air in the clothe care room 11. The clothes care room 11 may include a second duct 71, and the blower device 72 may be installed inside the second duct 71. The second duct 71 may be provided to communicate with the clothes care room 11 to form a second circulation passage 70 that circulates the clothes care room 11 and the second duct 71. The blowing device 70 may be disposed on the second circulation passage 70. The second duct 71 may be formed behind the second airflow inlet 12*a* of the clothes care room 11. The second duct 71 may be provided on a rear upper side of the clothes care room 11 and may include a filter member 60 therein.

The second duct 71 may be connected to the second airflow inlet 12*a* and the second airflow outlet 12*b* of the clothes care room 11. The second airflow outlet 12*b* may be connected to the clothes support member 50 so that air from the second duct 71 is transmitted to the clothes support member 50.

When air inside the clothes care room 11 is introduced into the second duct 71, the air may be filtered by the filter member 60 of the second airflow inlet 12*a*. Air flowing into the second duct 71 may have dust and odors filtered by the filter member 60.

Meanwhile, in the machine room 13, the steam generating device 40 may be provided to supply steam into the clothes care room 11. With the steam supplied into the clothes care room 11, foreign substances, such as dust, that are attached to clothes may be removed, and viruses and bacteria may be sterilized.

The steam generating device 40 may receive water from the supply water container 15*b* to form steam. The steam generating device 40 may include a steam container 41 connected to the supply water container 15*b* to receive water and generate steam, a steam supply pipe 42 guiding the steam generated in the steam container 41 to a steam injector 43, and the steam injector 43 connected to the steam supply pipe 42 and provided to inject steam into the clothes care room 11. The steam injector 43 may include a steam injection port 43*a* formed to inject steam into the clothes care room 11.

The steam supply pipe 42 may be connected to an upper portion of the steam container 41. The steam supply pipe 42 may be connected to a rear upper portion of the steam container 41. The steam injector 43 is disposed at an end of the steam supply pipe 42 and installed in the clothes care room 11. The steam injector 43 may be disposed on at least a portion of the rear surface of the clothes care room 11. In the embodiment of the disclosure, the steam injector is illustrated as being formed on a portion of the rear surface of the clothes care room, but the concept of the disclosure is not limited thereto.

Water supplied to the steam container 41 is delivered through the supply water container 15*b*. In general, water contains a small amount of minerals, such as calcium, magnesium, and potassium. Water containing minerals is referred to as hard water. Such hard water may cause scale to be generated in the steam container 41, and may cause malfunction of a product. A scale cleaning device 100 according to the disclosure is provided to clean scale generated in the steam container 41.

Figure 5:
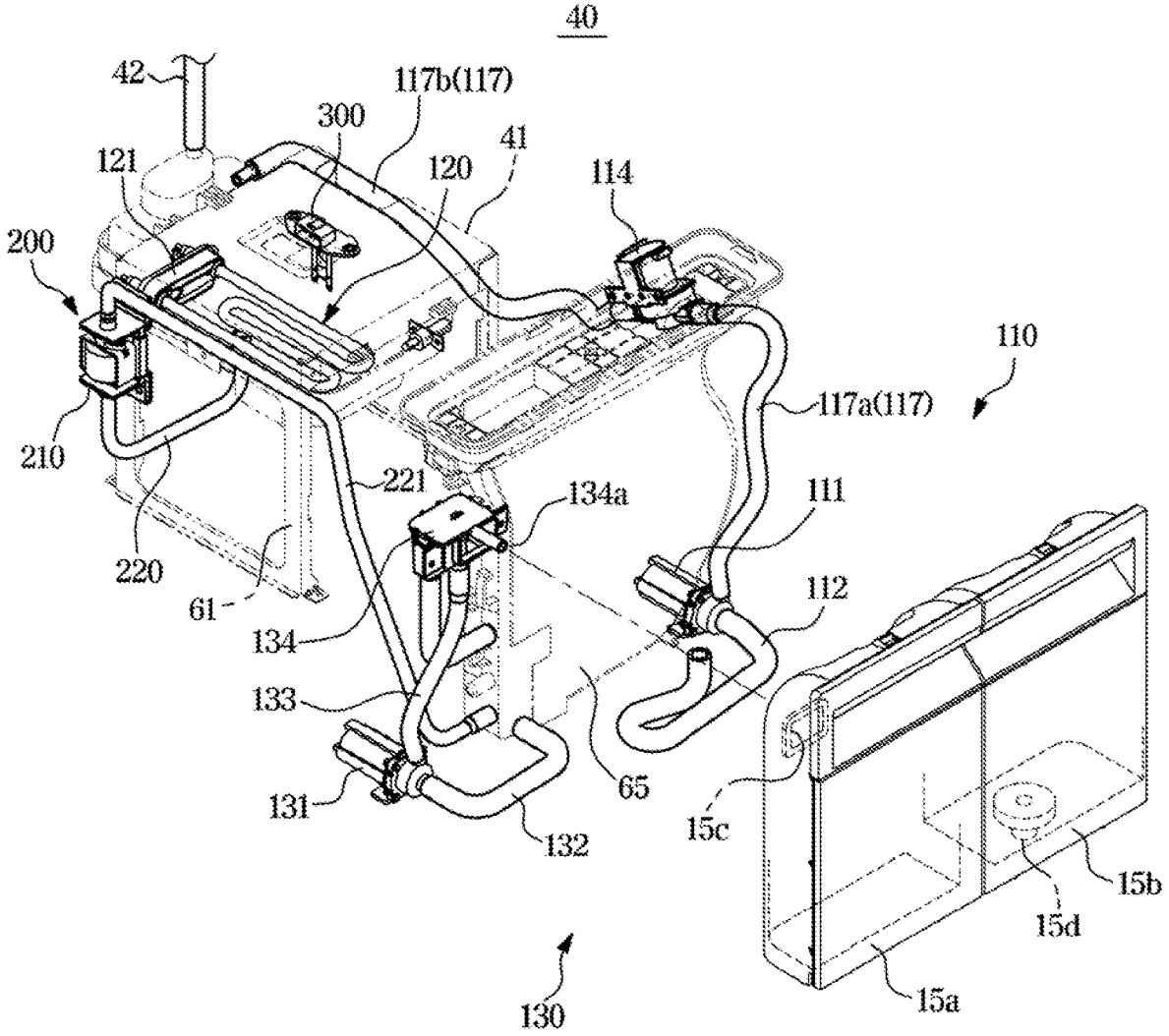
FIG. 5 is a perspective view illustrating a steam generating device according to an embodiment of the disclosure.
Figure 6:
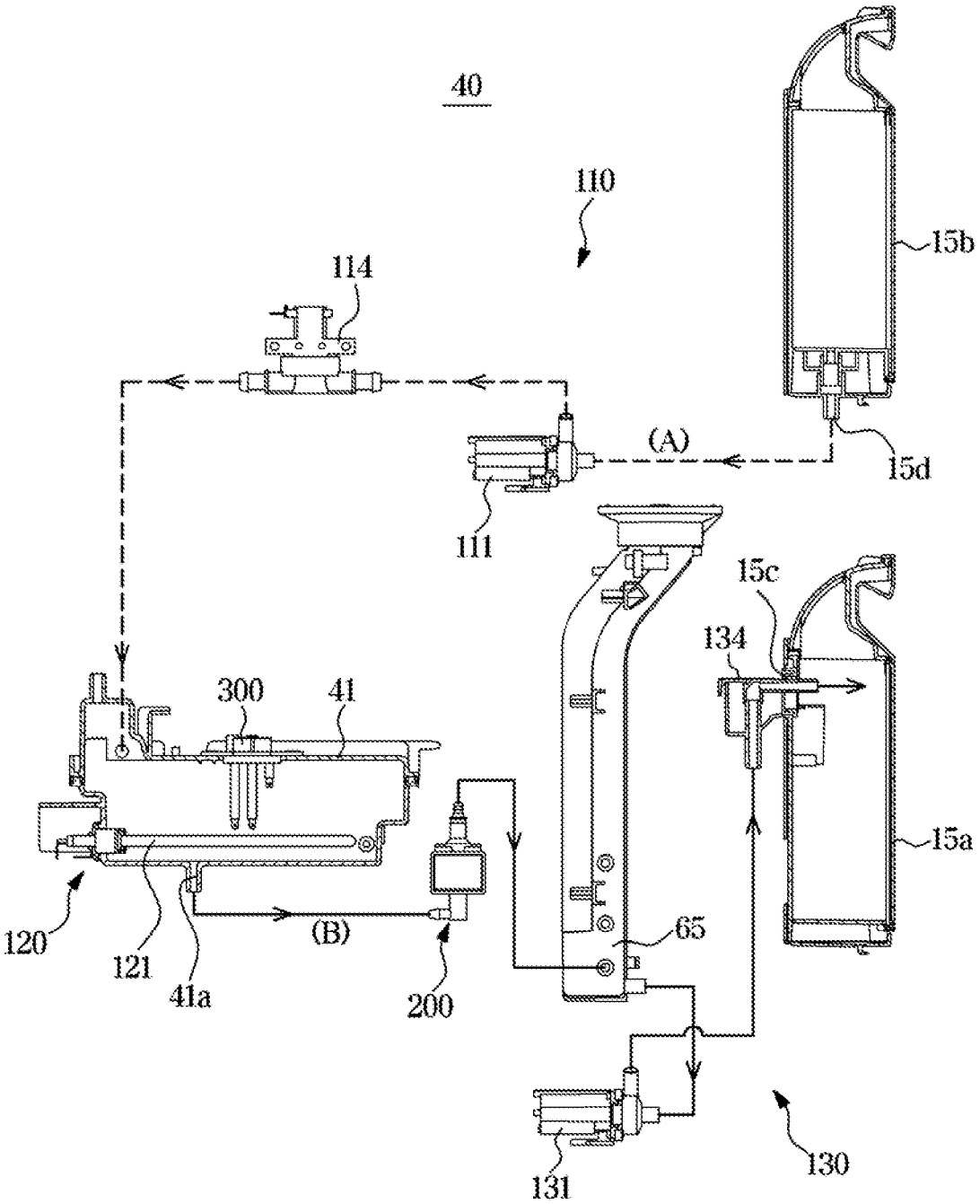
FIG. 6 is a view schematically illustrating a flow of a wash liquid for cleaning scale of a steam generating device according to an embodiment of the disclosure.

FIG. 5 is a perspective view illustrating a steam generating device according to an embodiment of the disclosure, and FIG. 6 is a view schematically illustrating a flow of a wash liquid for cleaning scale of a steam generating device according to an embodiment of the disclosure.

Referring to FIGS. 5 to 6, the steam generating device 40 includes a wash liquid injecting part 110 provided to inject a wash liquid for removing scale in the steam container 41, a heating part 120 provided to heat the wash liquid, and a wash liquid discharge part 130 provided to discharge the wash liquid having cleaned scale using heat received from the heating part 120.

The steam generating device 40 is disposed in the machine room 13 of the clothes care apparatus 1. The steam container 41 of the steam generating device 40 may be disposed on a frame 61 disposed in the machine room 13.

The wash liquid injecting part 110 of the steam generating device 40 includes the supply water container 15*b* provided to supply water to the steam container 41, a first pump 111 provided to move a wash liquid introduced into the supply water container 15*b* to the steam container 41, a first connecting member 117 connecting the first pump 111 to the steam container 41, and a first valve 114 disposed on a path of the first connecting member 117.

The supply water container 15*b* of the wash liquid injecting part 110 may be connected to the first pump 111 by a supply water connecting pipe 112. The supply water connecting pipe 112 may be connected to a lower end of the supply water container 15*b*. A supply water container connector 15*d* may be provided on the supply water container 15*b* so that the supply water connecting pipe 112 is connected to the supply water container 15*b*.

The first connecting member 117 of the wash liquid injecting part 110 may include a first connecting pipe 117*a* connecting the first pump 111 to the first valve 114 and a second connecting pipe 117*b* connecting the first valve 114 to the steam container 41. The first valve 114 is provided to supply water from the supply water container 15*b* to the steam container 41.

That is, the wash liquid injected into the supply water container 15*b* of the wash liquid injecting part 110 is pumped together with water by the first pump 111 and then is supplied to the steam container 41 through the first connecting member 117.

The steam container 41 may be provided with a water level sensor 300 for checking the amount of water supplied. The water level sensor 300 may be disposed at an inner upper side of the steam container 41. The water level sensor 300 senses the amount of water inside the steam container 41 and allows water from the supply water container 15*b* to be supplied to the steam container 41 by the first valve 114 and the first pump 111.

The heating part 120 of the steam generating device 40 may include a heater 121. The heater 121 may be installed inside the steam container 41. The heater 121 is provided to increase the temperature of water by heating the inside of the steam container 41. The heater 121 is provided to heat the water in the steam container 41 to form steam. Water mixed with a wash liquid that is supplied to the steam container 41 may be heated by the heater 121 to remove scale inside the steam container 41.

The wash liquid or water having cleaned the scale of the steam container 41 is discharged through the wash liquid discharge part 130.

The steam generating device 40 may include a second pump 200 provided to discharge the wash liquid having cleaned the scale using heat received from the heater 121 inside the steam container 41. The second pump 200 may include a function of a valve. The second pump 200 may include a valve-pump.

The second pump 200 may be installed on the frame 61 of the machine room 13. The second pump 200 may be disposed at a lateral side of the steam container 41. The second pump 200 may be located at a position lower than that of the steam container 41. The second pump 200 may be installed on a side surface of the frame 61. The second pump 200 may be disposed behind the machine room 13 for after-scale service.

The second pump 200 may be connected to the steam container 41 to a connecting pipe 220 through a connecting bracket 210. The connecting pipe 220 may be connected to a lower portion of the steam container 41. The connecting pipe 220 may be connected to a lower portion of the second pump 200. The steam container 41 may be provided at a lower surface thereof with a wash liquid outlet 41*a* that is to be connected with the connecting pipe 220. The connecting pipe 220 may connect the lower end of the steam container 41 to the lower end of the second pump 200.

The second pump 200 is provided to pump the wash liquid or water having removed the scale inside the steam container 41.

The steam generating device 40 may include the sump 65 provided to accommodate a wash liquid or water having cleaned the scale that is discharged from the second pump 200. The second pump 200 may be connected to the sump 65. The steam generating device 40 may further include a second connecting member 221 connecting the second pump 200 to the sump 65. The second connecting member 221 connects the second pump 200 to the sump 65. The second connecting member 221 is provided to deliver the wash liquid or water having cleaned the scale of the steam container 41 that is pumped by the second pump 200 to the sump 65.

The wash liquid or water having cleaned the scale of the steam container 41 that is delivered to the sump 65 through the second connecting member 221 is stored in the sump 65 together with the condensed water generated in the clothes care room 11.

The wash liquid discharging part 130 of the steam generating device 40 includes a third pump 131 connected to the sump 65 through a connecting pipe 132 to drain the wash liquid having cleaned the scale and connected to the drain water container 15*a* configured to receive water of the sump 65 that is discharged from the third pump 131 through a connecting pipe 133. The drain water container 15*a* is provided to receive the condensed water and the wash liquid or water having cleaned the scale, which are stored in the sump 65, by the third pump 131.

The drain water container 15*a* is connected to the third pump 131 through a connecting bracket 134. The connecting bracket 134 includes an insertion tube 134*a* protruding toward the drain water container 15*a*. The drain water container 15*a* is formed with an insertion hole 15*c* into which the insertion tube 134*a* of the connecting bracket 134 is inserted. At least a portion of the connecting bracket 134 is connected to the sump 65 to transfer water flowing back from the sump 65 to the drain water container 15*a*.

The drain water container 15*a* is provided to be detachable from the sump 65 or the main body 10.

Accordingly, when the condensate water and the wash liquid or water having cleaned the scale of the steam container 41 are delivered from the sump 65 to the drain water container 15*a* in a certain amount, a user may separate the drain water container 15*a* and empty the drain water container 15*a*.

An operation of removing scale by the steam generating device 40 according to the disclosure will be described below.

A wash liquid is injected into the supply water container 15*b* to remove scale in the steam container 41, and water A mixed with the wash liquid is transferred to the steam container 41 by the first pump 111 and the first valve 114.

Water A mixed with the wash liquid that is supplied into the steam container 41 is heated to an appropriate temperature by the heater 121 to remove scale inside the steam container 41 to clean the steam container 41.

Wash liquid having removed the scale or water B mixed with the wash liquid is pumped by the second pump 200 to be transferred to the sump 65 through the wash liquid outlet 41*a* formed at the lower portion of the steam container 41.

In this case, the second pump 200 serves as a valve to prevent the water in the steam container 41 from flowing backward.

The wash liquid having removed the scale or the water B mixed with the wash liquid which is transferred to the sump 65 may be mixed with condensed water generated in the clothes care room 11 and stored in the sump 65.

Part of the condensed water, the wash liquid having cleaned the scale, or the water mixed with the wash liquid, which are stored in the sump 65, may be delivered to the drain water container 15*a* by the third pump 131, and the user may separate the drain water container 15*a* from the main body 10 and empty the drain water container 15*a*.

Figure 7:
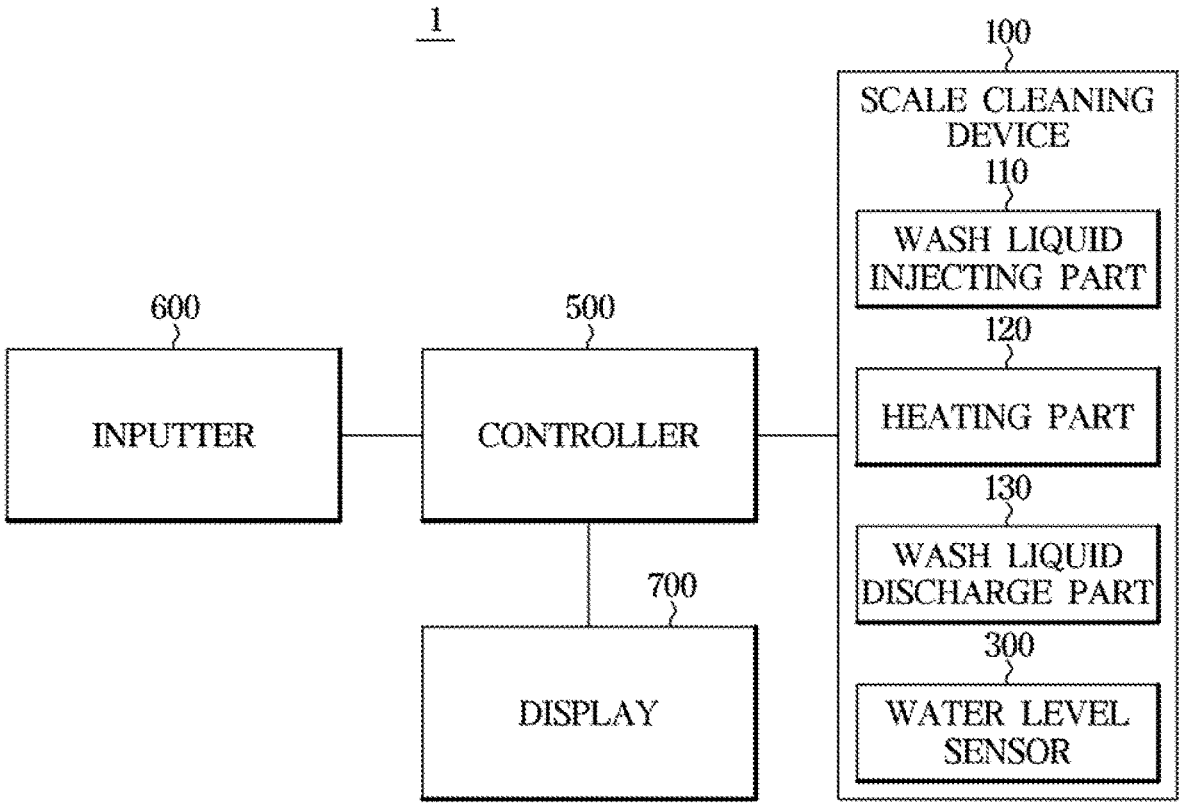
FIG. 7 is a control block diagram illustrating a clothes care apparatus according to an embodiment of the disclosure.

FIG. 7 is a control block diagram illustrating a clothes care apparatus according to an embodiment of the disclosure.

The clothes care apparatus 1 according to the embodiment may include an inputter 600, a display 700, a controller 500, and the scale cleaning device 100.

The scale cleaning device 100 may include the heating part 120, the wash liquid injecting part 110, the wash liquid discharging part 130, and the water level sensor 300.

The wash liquid injecting part 110 may be provided such that a wash liquid for removing scale is injected.

The wash liquid injecting part 110 may include a supply water container, and the user may inject the wash liquid into the supply water container as described below.

The wash liquid discharging part 130 may be provided to discharge the wash liquid cleaned the scale using heat received from the heating part 120. The wash liquid discharging part 130 may include a drain water container for receiving the wash liquid.

The heating part 120 may be provided in the interior of the steam container provided in the steam generating device to heat the wash liquid.

The inputter 600 includes a hardware device for a user input, such as various buttons, switches, pedals, keyboards, mouse, track-balls, various levers, handles, sticks, and the like.

In addition, the inputter 600 may include a graphical user interface (GUI), such as a touch pad, for a user input, that is, a software device. The touch pad may be implemented as a touch screen panel (TSP) to form a mutual layer structure together with a display (not shown).

The user may input a command to start an operation of removing scale of the water level sensor through the inputter 600.

The display 700 may output an image that guides removal of scale by the user, an image that guides removal of the wash liquid after removing of the scale, and the like.

The display 700 includes a cathode ray tube (CRT), a digital light processing (DLP) panel, a plasma display panel, a liquid crystal display (LCD) panel, an Electro Luminescence (EL) panel, an Electrophoretic Display (EPD) panel, an Electrochromic Display (ECD) panel, a Light Emitting Diode (LED) panel, an Organic Light Emitting Diode (OLED) panel, and the like, but is not limited thereto.

The controller 500 may determine whether scaling has occurred on the water level sensor 300 based on a comparison between a reference sensor value corresponding to a predetermined clothes care course and an output signal of the water level sensor 300.

That is, the controller 500 may store an appropriate water level of the steam container corresponding to a clothes care apparatus in advance, and in response to a predicted amount of water in the steam container in the corresponding clothes care apparatus being significantly different from the amount of water in the steam container, may determine that an abnormality has occurred in the water level sensor 300.

For example, the controller 500 may determine that an abnormality has occurred in the water level sensor 300 in response to the amount of water in the steam container not changing and constant when the user inputs a command to generate strong steam for a long time through the clothes care apparatus.

The controller 500 may control the scale cleaning device such that the wash liquid is discharged through the steam container based on a user command received through the inputter 600.

Specifically, the controller 500 may control the first pump and the first valve included in the wash liquid injecting part 110 to inject the wash liquid from the supply water container to the steam container.

In addition, the controller 500 may control the third pump included in the wash liquid discharging part 130 and the second pump included in the scale cleaning device so that the wash liquid is discharged via the steam container.

When the amount of change in the output signal is less than a predetermined value and water is introduced into the steam container, the controller 500 may determine that scaling has occurred on the water level sensor 300.

In addition, the controller 500, upon determining that water exists in the steam container based on an output signal at a time when a predetermined time has elapsed since an operation of supplying steam into the clothes care room starts, may determine that scaling has occurred on the water level sensor 300.

A detailed operation of the controller 500 determining that scaling has occurred on the water level sensor 300 will be described below.

The controller 500, upon determining that scaling has occurred on the water level sensor 300, may heat the wash liquid through the heating part 120 based on a user command. According to an embodiment, the wash liquid may be heated to 40° C. or higher in order to efficiently remove the scale generated on the water level sensor 300.

The controller 500 may stop discharging the wash liquid when the temperature of the wash liquid exceeds a predetermined temperature.

The temperature of the wash liquid may be obtained by at least one temperature sensor provided in the clothes care apparatus.

Meanwhile, the controller 500, upon determining that scaling has occurred on the water level sensor 300, may output an image on the display to guide removal of the scale.

The controller 500, in response to a predetermined time having elapsed since an operation of removing the scale starts, may output an image to guide removal of the drain water container included in the wash liquid discharging part 130. Details thereof will be described with reference to the following drawings.

The controller 500, upon determining that scaling has occurred on the water level sensor 300, may inject the wash liquid into the steam container for a predetermined minimum time. When scaling occurs on the water level sensor 300, it is difficult to accurately measure the amount of liquid inside the steam container. In order to prevent the steam container from overflowing, the controller 500 may supply a predetermined minimum amount of detergent to the steam container.

The controller 500, upon determining that the amount of the wash liquid included in the steam container being excessing the capacity of the steam container based on an output signal of another sensor included in the clothes care apparatus, may stop injecting the wash liquid.

According to the embodiment, the sump included in the clothes care apparatus may include another sensor capable of measuring the amount of moisture. Therefore, even when scaling occurs on the water level sensor and thus water level information of the steam container is not accurately obtained, the controller 500 may determine whether the amount of the wash liquid contained in the steam container exceeds the capacity of the steam container based on the sensor provided in the sump, Therefore, in this case, the controller 500 may stop supply of the wash liquid.

The controller 500 may include a memory (not shown) for storing data regarding an algorithm for controlling the operations of the components of the clothes care apparatus or a program that represents the algorithm, and a processor (not shown) that performs the above described operations using the data stored in the memory. In this case, the memory and the processor may be implemented as separate chips. Alternatively, the memory and the processor may be implemented as a single chip.

At least one component may be added or omitted to correspond to the performances of the components of the clothes care apparatus shown in FIG. 7. In addition, the mutual positions of the components may be changed to correspond to the performance or structure of the system.

Meanwhile, some of the components shown in FIG. 7 may refer to a software component and/or a hardware component, such as a Field Programmable Gate Array (FPGA) and an Application Specific Integrated Circuit (ASIC).

Figure 8:
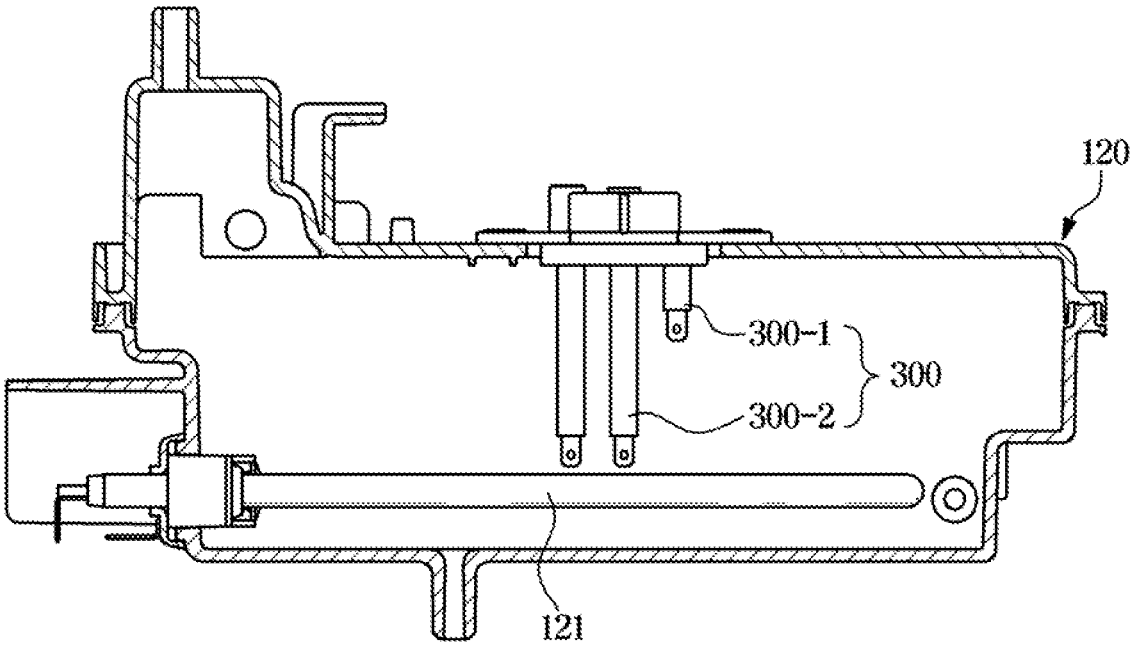
FIG. 8 is a view for describing a process in which scale is generated in a water level sensor according to an embodiment of the disclosure.

FIG. 8 is a view for describing a process in which scale is generated in a water level sensor according to an embodiment of the disclosure.

Referring to FIG. 8, the water level sensor 300 may include a plurality of electrodes 300-1 and 300-2.

The water level sensor 300 may determine the level of a liquid in the steam container through energization of the liquid inside the steam container.

The controller 500 may determine whether scaling has occurred on the water level sensor 300 based on a comparison between a reference sensor value corresponding to a predetermined clothes care course and an output signal of the water level sensor 300.

For example, as the clothes care apparatus performs a clothes care course for supplying steam, moisture in the steam container is consumed.

The controller 500 may store the reference sensor value for determining whether a low level of moisture exists in the steam container.

However, when scale is generated on the water level sensor, energization with the scale may occur in the water level sensor 300.

In this case, the water level sensor 300 may generate an output signal that indicating that a large amount of moisture exists in the steam container even when the steam supply course proceeds.

In detail, energization may occur in the upper electrode 300-1 of the water level sensor 300, and thus the water level sensor 300 may generate an output signal.

In this case, the controller 500 may determine that scaling has occurred in the water level sensor 300 and perform an operation of removing the scale.

According to another embodiment, upon determining that the amount of change in the output signal of the water level sensor 300 is less than a predetermined value, and water flows into the steam container based on an output signal of another sensor included in the clothes care apparatus, the controller 500 may determine that scaling has occurred on the water level sensor 300.

Specifically, various sensors other than the water level sensor 300 may be provided inside the clothes care apparatus, and it may be determined that water flows into the steam container based on the sensors.

When the actual amount of change in the value of the water level sensor 300 is small, the controller 500 may determine that energization of the water level sensor 300 caused by the scale leads to no change of the output signal.

In this case, the controller 500 may determine that scaling has occurred on the water level sensor 300 and perform an operation of removing the scale.

According to still another embodiment, the controller 500, upon determining that water exists in the steam container based on the output signal at a time when a predetermined time has elapsed since an operation of supplying steam into the clothes care room starts.

Specifically, when the clothes care apparatus starts the steam supplying course to supply steam using the moisture in the steam container, the moisture provided in the steam container is consumed, and eventually exhausted. However, when the water level sensor 300 generates an output signal indicating that water exists in the steam container even after a predetermined time has elapsed from the start of supplying steam, that is, even after a sufficient time to consume the moisture in the steam container, the controller 500 may determine that an abnormality has occurred in the water level sensor 300.

That is, since the output signal of the water level sensor 300 is a signal output by energization with the scale, the controller 500 may determine that scaling has occurred on the water level sensor 300.

Figure 9:
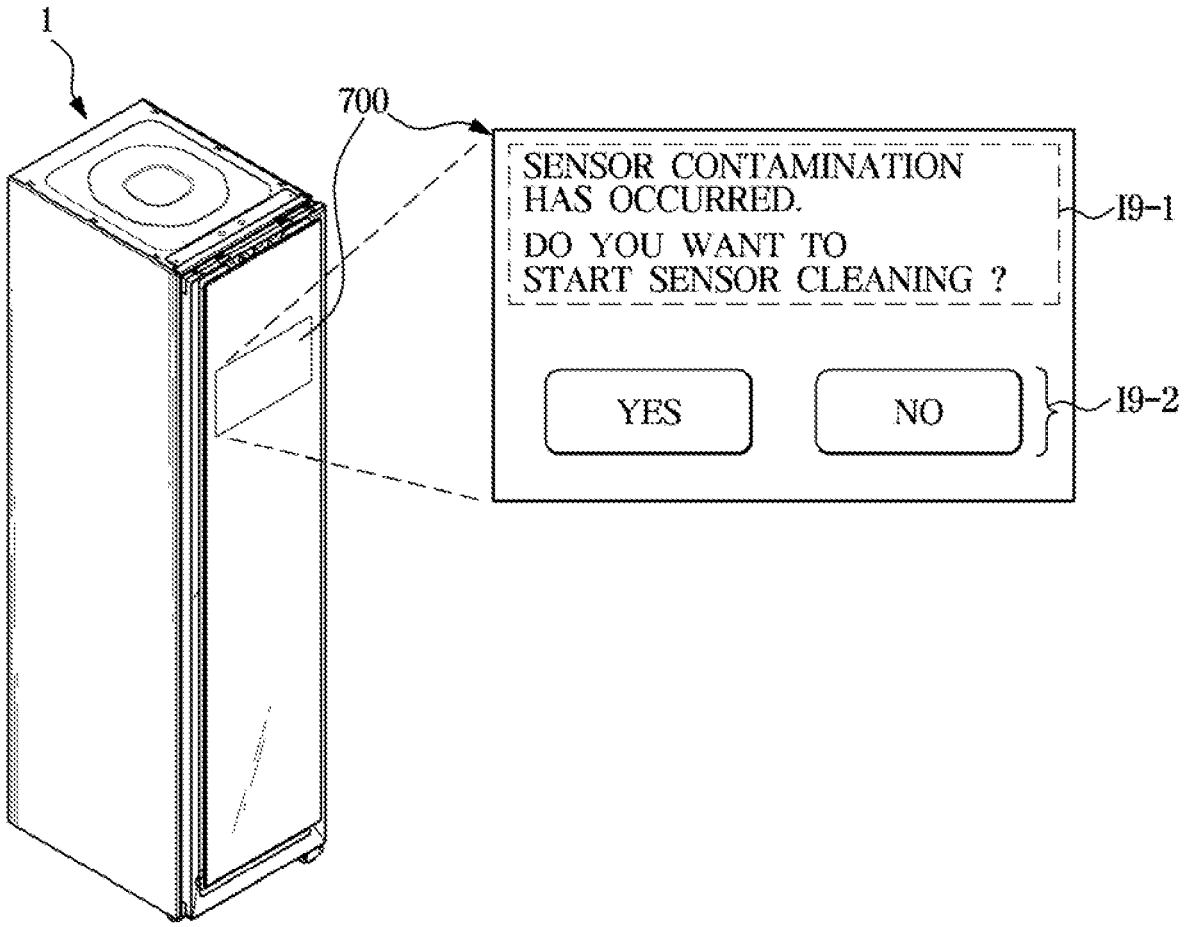
FIG. 9 is a view illustrating an interfaces provided to remove scale according to an embodiment of the disclosure.
Figure 10:
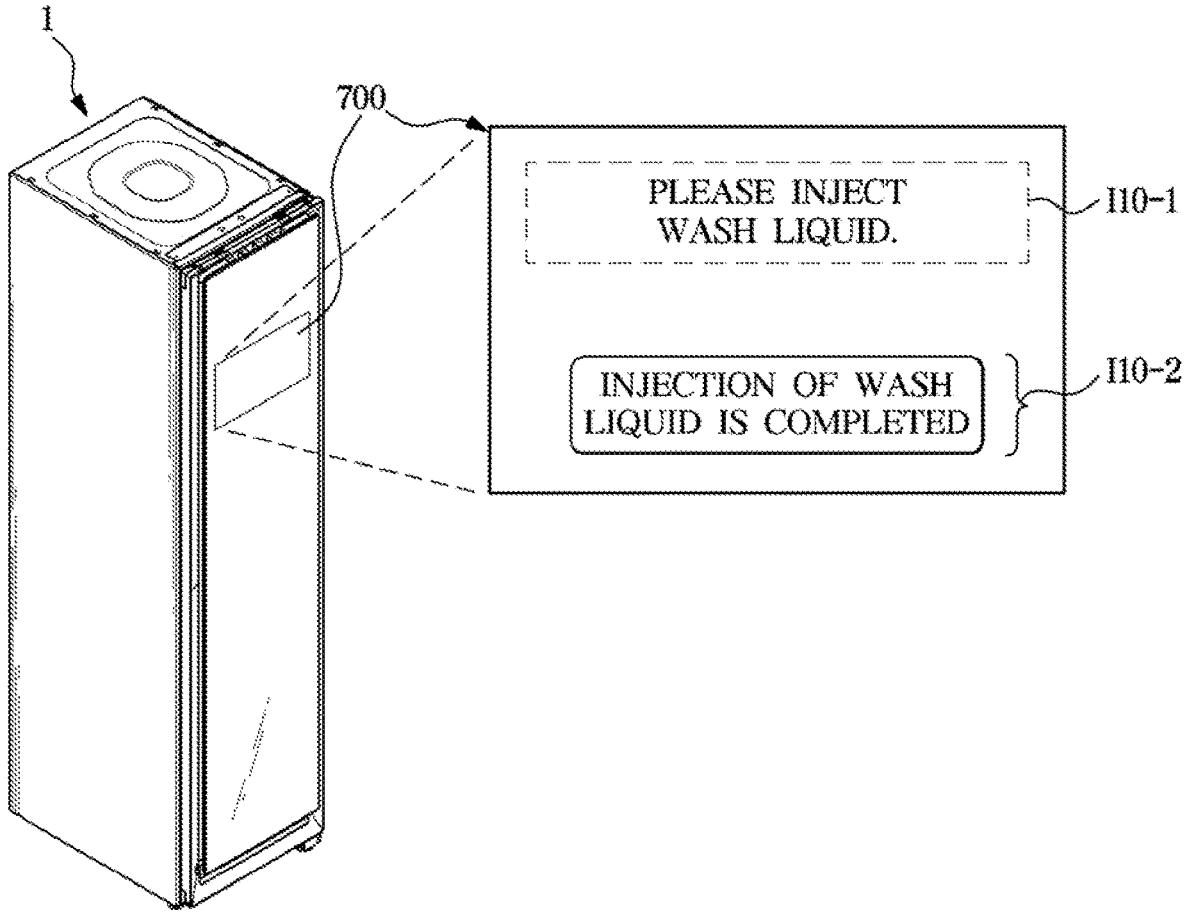
FIG. 10 is a view illustrating an interfaces provided to remove scale according to an embodiment of the disclosure.
Figure 11:
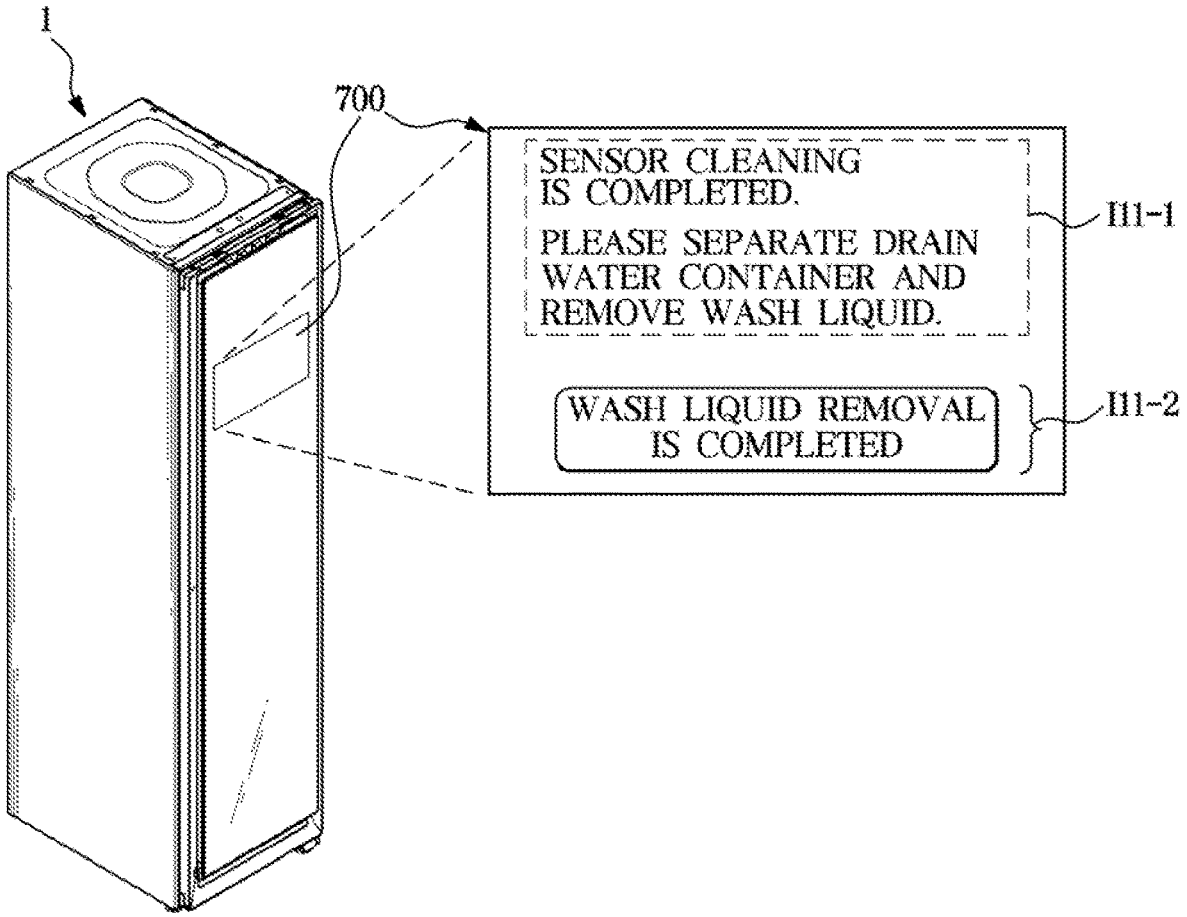
FIG. 11 is a view illustrating an interfaces provided to remove scale according to an embodiment of the disclosure.

FIGS. 9, 10, and 11 are views illustrating interfaces provided to remove scale according to an embodiment of the disclosure.

Referring to FIG. 9, the controller 500, upon determining that scaling has occurred in the water level sensor 300, may output an image I9-1 on the display to guide removal of scale.

Referring to FIG. 9, the controller 500 may determine that scaling has occurred in the water level sensor 300, and output an image I9-1 including a phrase, such as "Sensor contamination has occurred. Do you want to start sensor cleaning?" on the display 700. In addition, the controller 500 may output a user interface I9-2 for receiving an input of a user command. In FIG. 9, it can be seen that a button for a user to select a command starting an operation of removing the scale is output. The user may input a user command through the inputter 600. The inputter 600 may be provided in the form of a touch panel together with the display 700 or may be provided as a physical button, such as a separate button.

When the user inputs a user command by selecting "Yes", the controller 500 may output guide images I10-1 and I10-2 as shown in FIG. 10.

Referring to FIG. 10, the controller 500 may output an image for guiding injection of a wash liquid. In FIG. 10, it can be seen that a guide image I10-1 stating "Please inject a wash liquid" is output.

Accordingly, the user may inject the wash liquid into the clothes care apparatus and select the interface I10-2 stating "injection of wash liquid is completed" to thereby initiate an operation of removing scale.

Thereafter, the controller 500 may control the wash liquid injecting part 110 to cause the wash liquid to be injected into the steam container.

In addition, the controller 500 may control the heating part 120 to heat the wash liquid to a predetermined temperature range.

In addition, the controller may heat the wash liquid for a predetermined time through the heating part.

Here, the predetermined temperature range may be determined from 30 degrees C.° to 50 degrees C.°.

In addition, the predetermined time may be determined to a time between 30 minutes and 50 minutes.

Meanwhile, the controller may control the heating part as the above, to prevent evaporated wash liquid from spreading to other components.

When the scale removal through the wash liquid is completed, the controller may discharge the wash liquid to the outside using the wash liquid discharge part 130.

On the other hand, referring to FIG. 11, the controller 500, in response to a predetermined time having elapsed since the operation of removing the scale from the water level sensor 300 starts, may output images I11-1 and I11-2 for guiding removal of the drain water container included in the wash liquid discharging part 130.

The elapsing of the predetermined time since the start of removing the scale represents that the controller 500 has completed the operation of removing the scale.

In this case, the controller may determine that the wash liquid has been discharged to the drain water container through the steam container, and output an image I11-1 stating "Sensor cleaning is completed. Please separate the drain water container and remove the wash liquid".

Meanwhile, when the images are output, the user may separate the drain water container and remove the wash liquid.

On the other hand, after separating the drain water container, removing the wash liquid, coupling the drain water container to the clothes care apparatus again, the user may select the image I11-2 stating "Wash liquid removal is completed" to complete the scale removal.

The images and interfaces output on the display shown in FIGS. 9, 10, and 11 are only one embodiment of the disclosure, and the form of images and interfaces in which the controller 500 guides the user to remove the scale and complete the scale removal is not limited thereto.

Figure 12:
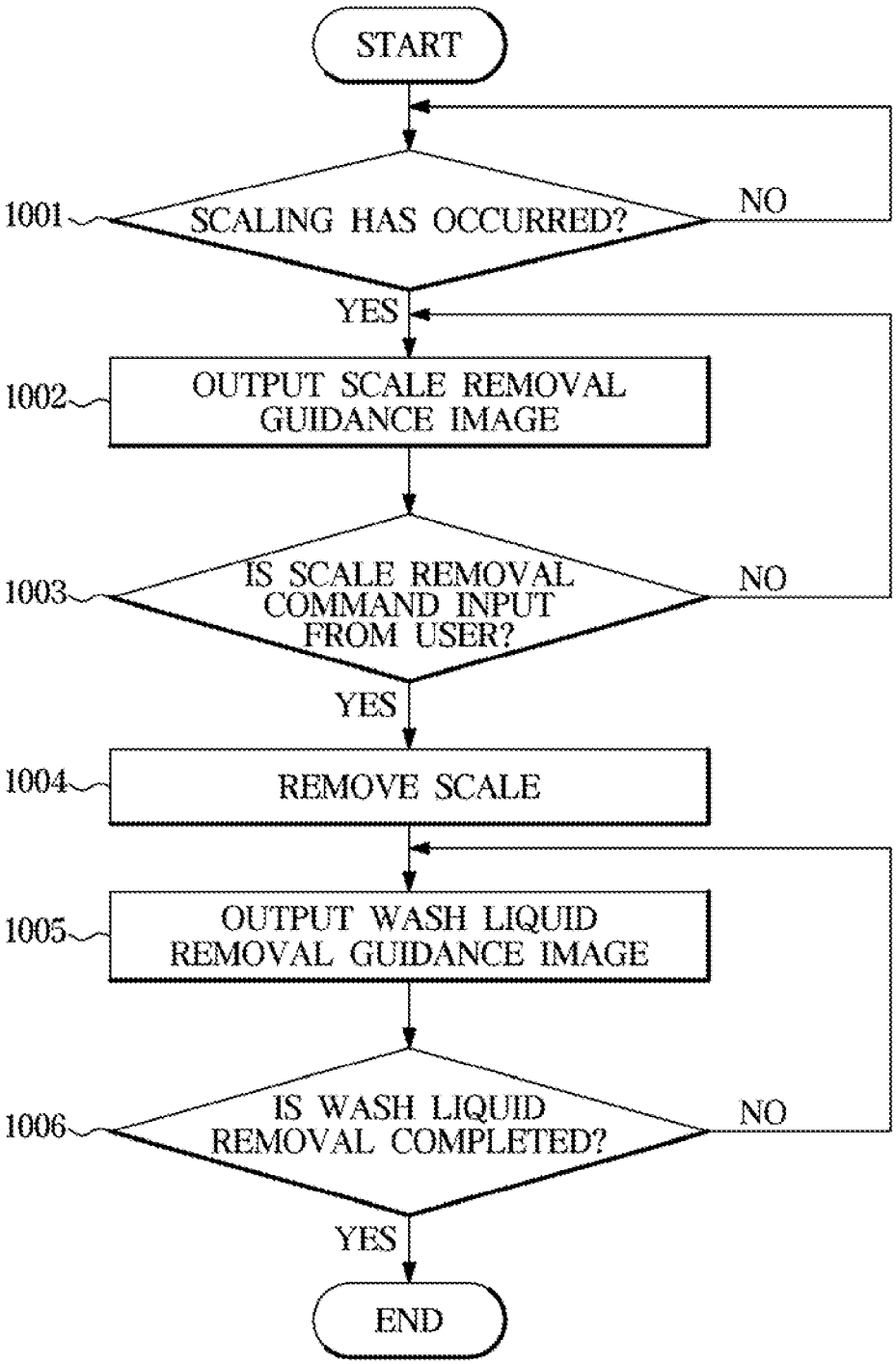
FIG. 12 is a flow chart according to an embodiment of the disclosure.

FIG. 12 is a flow chart according to an embodiment of the disclosure.

Referring to FIG. 12, the controller 500, upon determining that scaling has occurred on the water level sensor 300 during use of the clothes care apparatus (1001), may output an image on the display to guide scale removal (1002).

Meanwhile, based on a user inputting a scale removal command in response to the output image (1003), the controller 500 may perform a scale removal operation (1004).

The scale removal operation may be performed by discharging a wash liquid through the steam container and heating the wash liquid as described above.

Meanwhile, upon completion of such an operation, the controller 500 may output an image that guides an operation of separating the drain water container and removing the wash liquid (1005). The user may complete removal of the wash liquid to complete the scale removal (1006).

Meanwhile, the disclosed embodiments may be embodied in the form of a recording medium storing instructions executable by a computer. The instructions may be stored in the form of program code and, when executed by a processor, may generate a program module to perform the operations of the disclosed embodiments. The recording medium may be embodied as a computer-readable recording medium.

The computer-readable recording medium includes all kinds of recording media in which instructions which may be decoded by a computer are stored, for example, a Read Only Memory (ROM), a Random Access Memory (RAM), a magnetic tape, a magnetic disk, a flash memory, an optical data storage device, and the like.

As is apparent from the above, according to the embodiment of the disclosure, scale generated in the steam device can be cleaned.

In addition, product failure due to disconnecting of a heater caused by scale can be prevented, and fire due to malfunction of a sensor and a heater can be prevented.

Although exemplary embodiments of the disclosure have been described for illustrative purposes, those skilled in the art will appreciate that various modifications, additions and substitutions are possible, without departing from the scope and spirit of the disclosure. Therefore, exemplary embodiments of the disclosure have not been described for limiting purposes.

Although specific embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. A clothes care apparatus comprising:

a main body including a clothes care room; and a steam generating device provided to supply steam into the clothes care room, wherein the steam generating device includes:

a steam container;

a wash liquid injector provided to inject a wash liquid to clean scale in the steam container;

a heater provided inside the steam container to heat the wash liquid;

a wash liquid discharging part including a pump provided to discharge the heated wash liquid having cleaned the scale in the steam container using heat received from the heater to an outside of the steam container; and a water level sensor configured to detect an amount of water in the steam container, wherein the clothes care apparatus further includes:

an inputter; and a controller configured to:

upon determining that the scale exists on the water level sensor by comparing a reference sensor value corresponding to a predetermined clothes care course with an output signal of the water level sensor, control the wash liquid injector and the wash liquid discharging part to discharge the wash liquid through the steam container based on a user command received through the inputter.

2. The clothes care apparatus of claim 1, wherein the controller, when an amount of change in the output signal is less than a predetermined value and water is introduced into the steam container based on an output signal of another sensor included in the clothes care apparatus, determines that the scale is generated on the water level sensor.

3. The clothes care apparatus of claim 2, wherein the controller, in response to a temperature of the wash liquid being exceeding a predetermined temperature, stops discharging the wash liquid.

4. The clothes care apparatus of claim 1, wherein the controller, upon determining that water exists in the steam container based on the output signal at a time point when a predetermined time has elapsed since steam is supplied into the clothes care room, determines that the scale is generated on the water level sensor.

5. The clothes care apparatus of claim 4, wherein the controller, upon determining that the scale is generated on the water level sensor, injects the wash liquid into the steam container for a predetermined minimum time.

6. The clothes care apparatus of claim 5, wherein the controller, upon determining that an amount of the wash liquid included in the steam container being excessing a capacity of the steam container based on an output signal of another sensor included in the clothes care apparatus, stops injecting the wash liquid.

7. The clothes care apparatus of claim 1, wherein the controller, upon determining that the scale is generated on the water level sensor, heats the wash liquid through the heater based on the user command.

8. The clothes care apparatus of claim 7, wherein the controller heats the wash liquid through the heater for a predetermined time.

9. The clothes care apparatus of claim 1, further comprising a display, wherein the controller, upon determining that the scale is generated on the water level sensor, outputs an image on the display to guide removal of the scale.

10. The clothes care apparatus of claim 9, wherein the controller, in response to a predetermined time elapsed since an operation of removing the scale starts, outputs an image to guide removal of a drain water container included in the wash liquid discharging part.

11. A clothes care apparatus comprising:

a main body including a clothes care room; and a steam generating device provided to supply steam into the clothes care room, wherein the steam generating device includes:

a steam container;

a wash liquid injector provided to inject a wash liquid to clean scale in the steam container;

a heater provided inside the steam container to heat the wash liquid;

a wash liquid discharging part including a pump provided to discharge the heated wash liquid having cleaned the scale in the steam container using heat received from the heater to an outside of the steam container; and a water level sensor configured to detect an amount of water in the steam container, wherein the clothes care apparatus further includes:

an inputter; and a controller configured to, upon determining that the scale is generated on the water level sensor by comparing a reference sensor value corresponding to a predetermined clothes care course with an output signal of the water level sensor, control the pump to discharge the wash liquid through the steam container based on a user command received through the inputter.

12. The clothes care apparatus of claim 1, further comprising a sump provided to accommodate the wash liquid having cleaned the scale that is discharged from the pump.

13. The clothes care apparatus of claim 12, wherein the wash liquid discharging part includes:

an other pump connected to the sump to drain the wash liquid having cleaned the scale; and a drain container configured to accommodate the wash liquid having cleaned the scale that is discharged from the other pump.

14. The clothes care apparatus of claim 1, wherein the pump further includes a valve.

15. The clothes care apparatus of claim 1, wherein the pump is arranged at a position lower than a position of the steam container.

16. The clothes care apparatus of claim 1, further comprising a connecting pipe connecting the steam container to the pump, wherein the connecting pipe connects a lower portion of the steam container to at least a portion of the pump.

17. The clothes care apparatus of claim 1, wherein the wash liquid injector includes:

a supply water container provided to supply water to the steam container;

an other pump provided to move the wash liquid introduced into the supply water container to the steam container;

a connector connecting the other pump to the steam container; and a valve provided on a path of the connector.

* * * * *